US005102127A

United States Patent [19]

Pohrer

[11] Patent Number: 5,102,127

[45] Date of Patent: Apr. 7, 1992

[54] PACKAGE-UNIT ADJUSTABLE-HEIGHT BASKETBALL BACKBOARD SUPPORT

[75] Inventor: Christopher M. Pohrer, Arnold, Mo.

[73] Assignee: Aalco Manufacturing Company, St. Louis, Mo.

[21] Appl. No.: 661,675

[22] Filed: Feb. 27, 1991

[51] Int. Cl.[5] ..... A63B 63/08

[52] U.S. Cl. ..... 273/1.5 R; 248/641

[58] Field of Search ..... 273/1.5 R; 248/641, 248/656, 677

[56] References Cited

U.S. PATENT DOCUMENTS

| | | | |
|---|---|---|---|
| 3,881,724 | 5/1975 | Beveridge | 273/1.5 R |
| 2,916,288 | 12/1959 | Chervenka | 273/1.5 R |
| 4,643,422 | 2/1987 | Cramblett | 273/1.5 R |
| 4,948,127 | 8/1990 | Willard | 273/1.5 R |
| 4,951,944 | 8/1990 | Morgan | 273/1.5 R |

*Primary Examiner*—Edward M. Coven
*Assistant Examiner*—Steven B. Wong
*Attorney, Agent, or Firm*—Jerome A. Gross

[57] ABSTRACT

A pre-assembled package-unit for adjusting the height of a basketball backboard includes a fixed assembly including a pair of vertical square tubes into whose downward ends fit the square tubes of an upward telescoping assembly which bears lower brackets to support the backboard. On the outer square surfaces of the fixed assembly slide the internally-squared surfaces of upper brackets extending to the backboard. An electric linear actuator, mounted on the fixed assembly and extending to the telescoping assembly, is powered and controlled from below by a hand-held electric wand to adjust the height of the backboard. The squared construction firmly resists side forces imposed on the backboard.

5 Claims, 1 Drawing Sheet

PACKAGE-UNIT ADJUSTABLE-HEIGHT BASKETBALL BACKBOARD SUPPORT

BACKGROUND OF THE INVENTION

1. Field of the Invention

This invention relates to basketball backboard mounting assemblies having variable height adjustment means.

2. Description of Related Art

Basketball hoops mounted on backboards are normally supported from above at a height of ten feet. This height is formidable for shorter players and almost impossible for children. Adjustable-height backboard support units which permit the basket hoop to be lowered to say eight feet, are in use at school gymnasiums, YMCA's and like places. Those adjustable units known to Applicant require on-site assembly and installation, usually on a pair of vertical round tubes mounted from a ceiling structure and assembly, to be made at site, including a second pair of tubes from which backboard support brackets project forwardly. A crank-type linear adjustment screw raises and lowers the height-adjustable assembly relative to the fixed members.

In one prior art unit the first pair of round ceiling-mounted tubes have open lower ends into which are inserted a pair of internal tubes which telescope slidingly upward within the fixed tubes. From the lower ends of the interior telescoping tubes, brackets extend forward to a third pair of tubes from which forward-projecting brackets are used to mount the backboard. The upper ends of the third pair of tubes have ring-like slides which slide along the outer wall of the fixed tube.

An inherent weakness in these height-adjustable support mechanisms, besides the inconvenience of assembling them on site, and the frequent maintenance required to tighten the various components, is the fact that sideward forces applied to the basketball hoop or backboard cause the brackets which project forward from the slidable tubes to deflect angularly. While this angular deflection is resisted by the backboard itself, out-of-plane stresses are imposed on the backboard, which may in time damage it. Since the tubes are round, this problem is not alleviated by increasing their diameter or wall thickness.

SUMMARY OF THE INVENTION

The purposes of the present invention are to provide, as a pre-assembled package unit for adjusting the height of a backboard, a slender, compact, sturdy upward-telescoping structure and linear actuator mechanism, which may be readily installed as an operating unit merely by clamping it at appropriate height to an available ceiling-mounted structure; and which telescoping structure itself firmly resists side forces imposed on the backboard, to save it from damage.

The present invention is uniquely adaptable for providing such adjustability in existing installations because it may be interposed between the backboard and its structural support means, thereby maintaining the previously established regulation distance between the goals at either end of the playing court.

In the present invention, a substantially square stationary frame is welded from square (or other non-circular) hollow metal tubing. Within the two fixed vertical hollow members of the stationary frame portion are the vertical tubes of a U-shaped telescoping frame, having such external conformation as to fit slidably upward within the hollow vertical members of the stationary frame. The vertical tubes of the telescoping frame are connected beneath their lower ends by a cross beam. At each end of this cross beam is a bracket which extends forwardly, whereon to mount the lower portion of a backboard. Brackets affixed to the upper portion of the backboard extend back and upward toward the stationary frame fixed vertical members, and terminate in slide assemblies mounted on their exterior surfaces.

Because of the close fit of the telescoping vertical tubes within the fixed vertical hollow members, and the fit of the slide assemblies on their exterior surfaces, the brackets which support the backboard cannot deflect angularly, regardless of the intensity of sideward forces imposed on the hoop or backboard. This not only saves the tackboard from damage but lessens objectionable vibrations.

While the unit may utilize a familiar hand-crank operated screw actuator, a preferred feature is the inclusion in the assembly of an electric linear actuator, powered and controlled from below by a portable electrical conductive wand, which may be connected to a convenient extension cord. At the base of the wand is a manually operated control which directs the actuator to extend, retract or stop. The wand carries the three wires necessary for operation together with a ground. It is rigid, and at its upper end is a plug which may enter a downward-facing electrical receptacle borne by a cross beam of the unit.

DESCRIPTION OF THE PREFERRED EMBODIMENT

Figure 1:
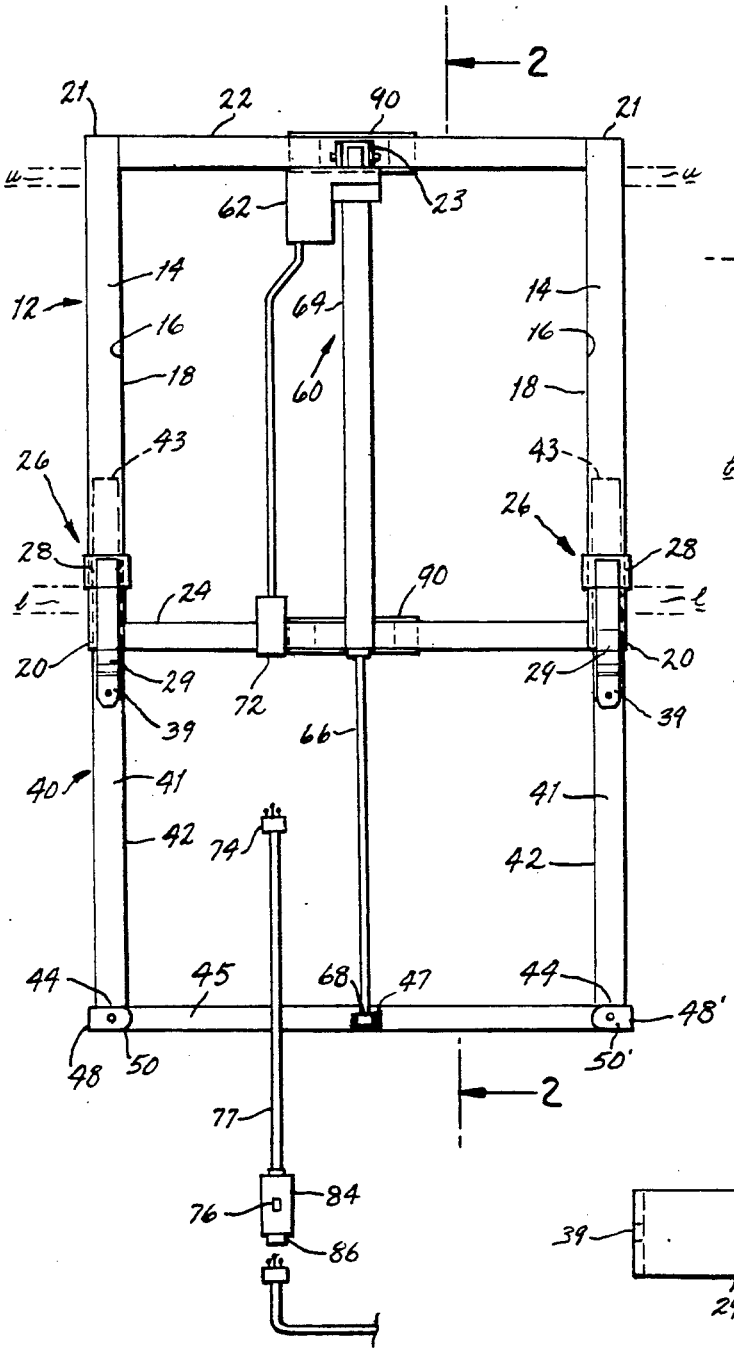
FIG. 1 is an elevational view without a backboard attached of the upward-telescoping adjustable-height backboard mount, with the telescoping frame portion fully extended by the linear actuator. The portable conduit and control wand is shown below the receptacle into which it may be fitted.

A preferred embodiment of the upward-telescoping height-adjustable mount means 10 of the present invention, shown in elevational view in FIG. 1, comprises: a stationary frame portion, generally designated 12, a telescoping frame portion, generally designated 40, upper backboard support slide bracket assemblies, generally designated 26, linear actuator means 60, and an electric control switch 76.

The stationary frame portion 12 constructed of 3/16" thick square tubular steel, 2½" by 2½", has vertical parallel hollow members 14, each having upper ends 21 and open lower ends 20 with interior sliding surfaces 16 and exterior sliding surfaces 18 extending upward from the lower ends 20. As shown in FIG. 1, an upper cross beam 22 having on its forward surface a clevis bracket 23 extends between the members 14 at the upper ends 21; a lower cross beam 24 (having a similar attachment point, not shown) extends between the members 14 at the open lower ends 20.

Figure 2:
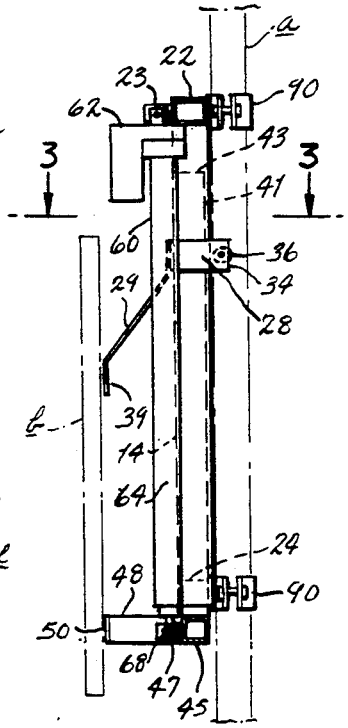
FIG. 2 is a side elevational view partly in cross-section as seen along line 2—2 of FIG. 1.

A telescoping frame portion 40, constructed from ⅛" thick square tubular steel, 2"×2", includes parallel telescoping vertical square tubes 41, shown in fully extended position in FIG. 1, one such tube 41 being shown in hidden lines in FIG. 2. Each of these vertical tubes has outer sliding surfaces 42 extending between tube upper ends 43 and the downward-projecting tube lower ends 44. A cross beam 45 having a forward surface extends, beneath the tube lower ends 44 between the telescoping vertical tube 41, the beam 45 having a clevis bracket 47 mounted at the mid-point of the forward surface. Each end of the cross beam 45 bears a rigid forwardly-extending lower backboard bracket 48, 48', at whose forward end is a vertical faced lug 50, bored for attachment of the backboard b.

Figure 3:
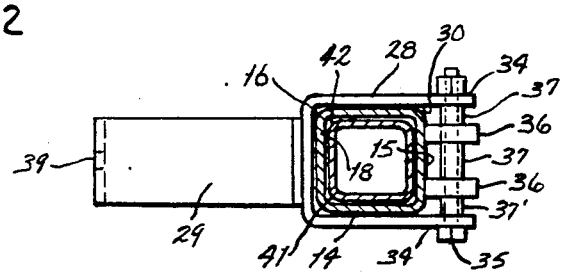
FIG. 3 is an enlarged view of one of the upper backboard bracket support assemblies as seen from above, showing the fixed and sliding vertical tubes in cross-sections, as seen along line 3—3 of FIG. 2.

Mounted on each of the exterior slide surfaces 18 of the stationary frame fixed vertical members 14 between the upper cross beam 22 and the lower cross beam 24, is an upper backboard bracket slide assembly generally designated 26, and shown in FIG. 3, made up of a yoke or "U" shaped sliding member 28 and a forwardly and downwardly slanting bracket arm 29.

The U-shaped sliding member 28 has an interior sliding surface 30 so sized as to slide along the vertical member exterior slide surfaces 18. The sliding member sides extend beyond the vertical member rear surfaces 15 to form a yoke 34, connected by a bolt 35 on which are mounted a pair of rollers 36 separated by spacers 37, 37'. The bracket arm 29 is welded to the forward surface of the U-shaped member 28 and extends downwardly and forwardly therefrom to a vertical lug end 39, bored for bolted attachment of the upper portion of the backboard b.

Conventional electric linear actuator means 60, shown in FIG. 1, available from Dayton Electric Manufacturing Company of Chicago, Ill., as Gear Motor Model 6Z086 and Linear Actuator Model 6Z091, includes a gear motor 62, a casing tube 64 extending vertically therefrom, and a drive tube 66 retractable therein, shown partially extended in FIG. 1, terminating at its end 63 remote from said gear motor 62 in an eye rod end 68.

As shown in FIG. 1, a four-wire conduit 70 leads downwardly from the linear actuator gear motor 62 to a four-wire receptacle 72 mounted on the stationary-frame portion lower cross beam front face 25 and presented downwardly for insertion of the conduit and control wand 77, hereinafter described, to enable up, down, and off control of the linear actuator 60.

Fittable within this downwardly presented receptacle 72 is the four-pronged plug 74 located at the upper end of the conduit control wand 77. The hollow plastic wand 77 illustrated in FIG. 1 contains a four-wire electric conduit, three wires for reversing control and one wire for grounding. The conduit leads from the four-pronged plug 74 to a conventional up, off, down control switch 76, obtainable from Advance Controls, Inc., contained in a box 84 which serves as a handle for the wand 77. The lower end of the control box 84 contains a conventional three-wire receptacle 86 so that power may be supplied through a conventional three-wire extension cord.

The linear actuator gear motor 62 is centrally mounted by a clevis 23 on the stationary frame upper cross beam 22 forward face; the end of the linear actuator casing tube 64 remote from the gear motor 62 is similarly attached to a central mounting point (not shown) on the stationary frame lower cross beam 24 front forward face. The linear actuator eye rod end 68 is attached to the clevis 47 on the telescoping frame portion cross beam 45.

For installation the entire assembly 10 is then attached by conventional clamps 90 to a central ceiling support a shown in phantom lines in FIG. 2. A backboard b is then attached to the lug end 39 of each upper backboard slide assembly 26 and the lug end 50 of each lower backboard bracket 48.

For adjusting the height of the backboard b, a conventional electric extension cord is inserted into the conventional three-wire receptacle 86 in the control box 84 of the wand 77, the wand four-wire plug 74 is then inserted into the four-wire receptacle 76 and the control switch 82 is used to extend or retract the linear actuator 60, thereby lowering or raising the telescoping frame portion 40.

Alternately, if the gymnasium is equipped with a pair of ceiling-mounted supports, the width of the entire stationary frame portion and telescoping frame portion may be so constructed as to coincide with that width. Mounting of the backboard on such paired supports requires that the conventional attachment means used provides sufficient clearance for sliding of the upper backboard slide assembly. To lessen the amount of such clearance, slide sleeves with flat rear surfaces may be substituted for the yoke and rollers hereinabove described. For this type of installation, a pair of upper clamps 90 are affixed around the stationary frame portion vertical members 14 at the level u indicated in FIG. 1; while similar lower clamps 90 are installed about these members at the level l, immediately above the lower cross beam 24.

As various modifications may be made in the constructions herein described and illustrated without departing from the scope of the invention, it is intended that all matter contained in the foregoing description or shown in the accompanying drawings shall be taken as illustrative rather than limiting.

I claim:

1. For interposition between a basketball backboard and structural support means therefor, an upward-telescoping height-adjustable mount means comprising (A) a stationary frame portion having two parallel vertical fixed-position members comprised of metal tubing, having non-round exterior and interior surfaces, said members having open lower ends and interior slide surfaces extending upward therefrom, and upper beam means interconnecting their upper ends;

(B) a telescoping-frame portion including two parallel telescoping vertical members having outer slide surfaces fittable slidable within the open lower ends and interior slide surfaces of said stationary-frame portion fixed members, and having downward-projecting lower ends and beam means interconnecting said ends, there being at said downward-projecting ends, lower bracket means projecting therefrom away from plane of said two parallel stationary-frame portion fixed members, whereby to project toward such backboard, further including (C) upper backboard bracket members similarly projecting from said plane and including means for vertical sliding along the exterior surfaces of said stationary-frame tubular members, together further with (D) linear actuator means for adjustably establishing the vertical spacing between said upper beam means of said fixed frame and said beam means of said telescoping frame, whereby on securing both said lower bracket means and said upper bracket means to such backboard, and on operating said linear actuator, the slide surfaces of said telescoping frame vertical members may slide vertically within the interior slide surfaces of said stationary-frame vertical members while said means for vertical sliding of said upper bracket members slide vertically along the exterior slide surfaces of said stationary-frame vertical members, nevertheless resisting sideward forces imposed on such backboard.

2. The upward-telescoping height-adjustable mount means as defined in claim 1, wherein said linear actuator means has a mounting point at said stationary-frame upper beam means, and operatively extends to said telescoping-frame beam means, and conductor and control means for supplying electric current to said linear actuator for extension and retraction thereof.

3. The upward-telescoping height-adjustable mount means as defined in claim 2, further including a receptacle projecting from and presented downwardly from the stationary portion of said mount means, together with a rigid wand mounting an electric connector extending from a plug end for mating with said receptacle.

4. The upward-telescoping height-adjustable mount means as defined in claim 1, further including lower beam means interconnecting said lower ends of said stationary-frame vertical members wherein the stationary portion of said mount means includes a downwardly-presented electric receptacle therefor in further combination with a hand-carried electric-conduit wand having at one end an electric plug adapted to mate with and disconnect from said receptacle.

5. The upward-telescoping height-adjustable backboard mount means as defined in claim 1, wherein said upper backboard bracket member means for vertical sliding includes slide-sleeve means about said fixed-frame member exterior slide surfaces, said means further including roller means so mounted to minimize friction with stationary-frame member exterior sliding surfaces.

* * * * *

UNITED STATES PATENT AND TRADEMARK OFFICE

CERTIFICATE OF CORRECTION

PATENT NO. : 5,102,127

DATED : April 7, 1992

INVENTOR(S) : Pohrer, Christopher M.

It is certified that error appears in the above-identified patent and that said Letters Patent is hereby corrected as shown below:

In column 2, line 15, change "tackboard" to ---backboard---;

In Claim 3, column 6, line 6, after "receptacle" insert ---a control means at the wand end opposite thereof, and means for connecting said wand to an electric extension cord---.

Signed and Sealed this

Fifteenth Day of June, 1993

Attest:

Michael K. Kirk

MICHAEL K. KIRK

Attesting Officer

Acting Commissioner of Patents and Trademarks